United States Patent [19]

Montgomery et al.

[11] 4,203,342

[45] May 20, 1980

[54] DEVICE FOR AFFECTING DEFLECTION CONTROL OF AN ELONGATED MUSICAL INSTRUMENT SHAFT

[76] Inventors: John R. Montgomery, 1020 Spruce St., Winnetka, Ill. 60093; James S. Richards, 945 E. Kenilworth, #330, Palatine, Ill. 60067

[21] Appl. No.: 945,306

[22] Filed: Sep. 25, 1978

[51] Int. Cl.[2] ..... G10D 3/00

[52] U.S. Cl. ..... 84/293

[58] Field of Search ..... 84/275, 291, 293

[56] References Cited

U.S. PATENT DOCUMENTS

| | | | |
|---|---|---|---|
| 1,446,758 | 2/1923 | McHugh | 84/293 |
| 1,912,106 | 5/1933 | Turturro | 84/293 |
| 2,056,474 | 10/1936 | Low | 84/293 |
| 2,100,249 | 11/1937 | Hart | 84/293 |
| 2,460,943 | 2/1949 | Nelson | 84/293 |
| 2,478,136 | 8/1949 | Stromberg | 84/293 |
| 3,159,072 | 12/1964 | Burns et al. | 84/293 |
| 3,901,119 | 8/1975 | Siminoff | 84/293 |
| 4,074,606 | 2/1978 | Fender | 84/293 |

FOREIGN PATENT DOCUMENTS

| | | | |
|---|---|---|---|
| 151283 | 8/1955 | Sweden | 84/293 |
| 967228 | 8/1964 | Sweden | 84/293 |
| 978931 | 1/1965 | United Kingdom | 84/293 |

*Primary Examiner*—L. T. Hix
*Assistant Examiner*—Benjamin R. Fuller
*Attorney, Agent, or Firm*—A. Andrew Olson, III

[57] ABSTRACT

A device for affecting deflection control of an elongated stringed musical instrument neck or shaft is provided to compensate for undesired neck deflections. The device includes a substantially rigid sleeve which is carried within and extends along the neck. At least one core element is removably positioned within the sleeve. A control element is adjustably secured to the sleeve and cooperates with the core element or elements to exert deflection control forces on the sleeve. The sleeve in turn, imparts such deflection control forces to the elongated neck or shaft in which it is carried.

16 Claims, 10 Drawing Figures

FIG. 1
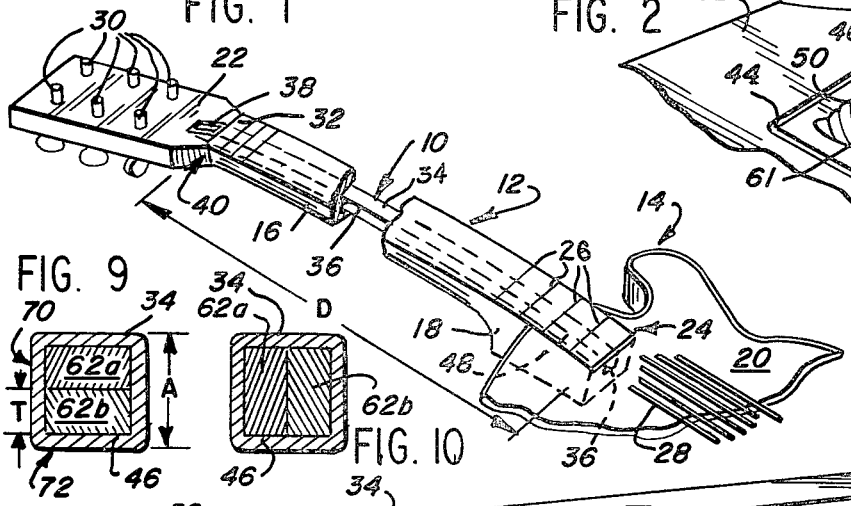
FIG. 2
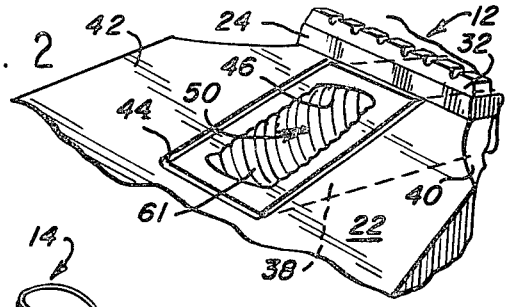
FIG. 9
FIG. 10
FIG. 3
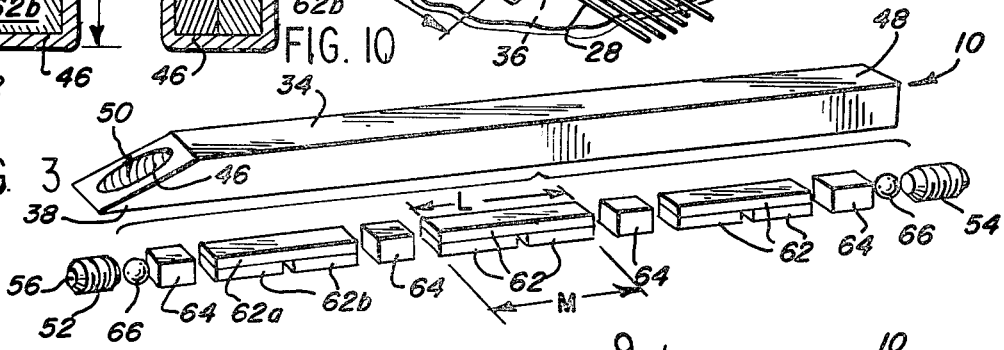
FIG. 4
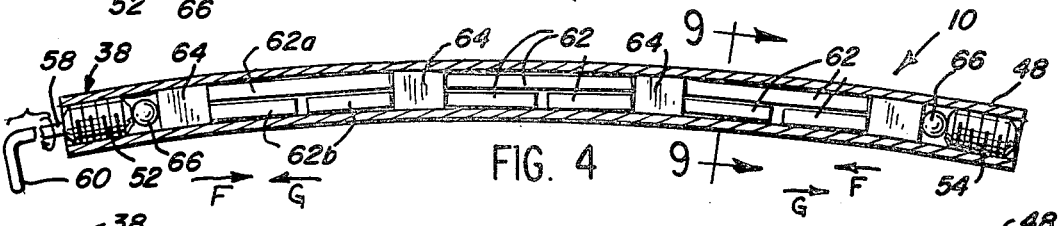
FIG. 5
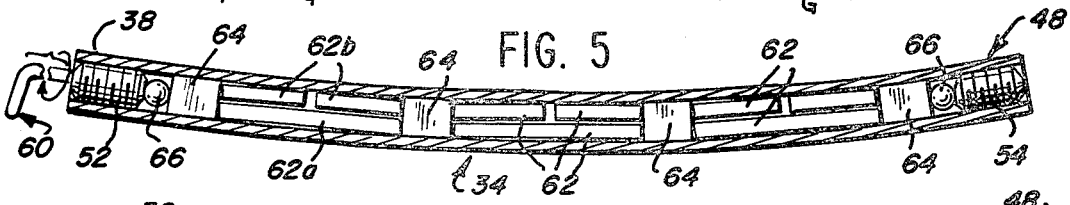
FIG. 6
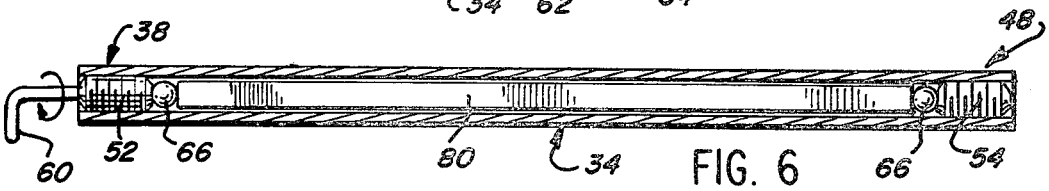
FIG. 7
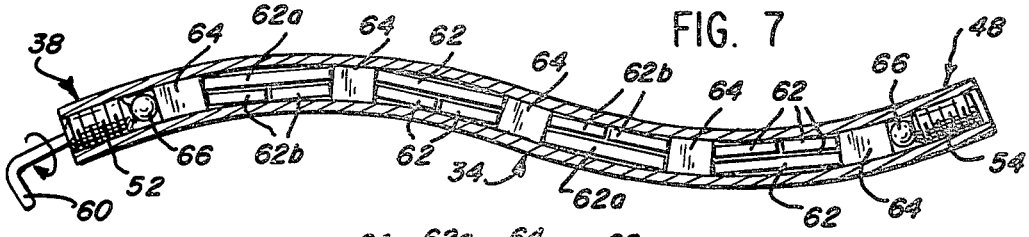
FIG. 8
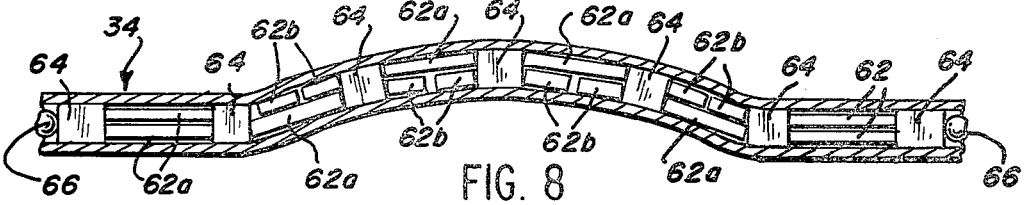

DEVICE FOR AFFECTING DEFLECTION CONTROL OF AN ELONGATED MUSICAL INSTRUMENT SHAFT

BACKGROUND OF THE INVENTION

This invention relates to a device for affecting deflection control of an elongated shaft, and more particularly to a device for countering undesirable bending forces along the elongated neck of a stringed musical instrument.

In the modern design and construction of stringed musical instruments, the structural integrity of some components of the instrument, such as the elongated shaft or neck, may be detrementally affected by the dictates of certain aesthetic design considerations as, for example, the current market preferance for slim necks. In addition, the selection of materials from which the instrument is constructed may be prone to warpage or other structural deterioration encountered as the instrument ages and/or is exposed to the environment.

These inherent problems are particularly critical to the utility of a stringed instrument when they alter the camber or proper extension of the neck. This proper extension is critical because the tonal quality and playability of the instrument are directly related to the proper clearance and attitude of the strings as drawn over the instrument's neck, and over the pitch-defining ribs or frets along the neck - in the case of fretted instruments, such as the guitar.

Generally, to counter the undesirable distortion and lack of structural rigidity of the neck, a substantially rigid element or series of elements may be inserted or incorporated into the instrument's neck. The tension exerted by such elements may be adjustable or passive, and/or the elements or element may be removable from the neck to change the force-exerting characteristics thereof. However, the mere application of a tension force along the entire length of the neck does not account for the need to provide localized deflection control for warpage or the like, occuring along a short segment thereof.

In addition, devices that utilize the instrument neck as a component part of the adjustable structure, subject the neck to undesirable side-effect forces, which may result in concomitant distortions. In particular, compression and twisting, or torque, forces exerted on the neck by such devices may result in a loss of payability, tonal quality and intonation and sometimes promote a complete functional failure of the neck.

During the life of the instrument, it may become necessary to adjust or to completely alter the bending characteristics of the elements or element to compensate for newly discovered distortions of the neck. The substantial or complete removal of the elements or element from the neck may be necessitated and/or require delicate procedures and substantial amounts of time to achieve the desired bending qualities. If these procedures fail the entire neck must be replaced.

Finally, the structural integrity of the neck has been augmented by employing a rigid beam for enhanced stiffness. Employing a nonadjustable and rigid device within the neck may provide the desired structural integrity, but such a device is not adapted to correct undesirable deflections of the neck over the instrument's lifetime. And, utilization of a prior art device which is adjustable may require accurate and difficult adjustment and/or modification, exert undesired additional forces on the neck, provide unpredictable bending only over the extended length of the neck and still fail to achieve the desired results.

OBJECTS OF THE INVENTION

Accordingly, it is an object of the present invention to provide an improved, low cost device for affecting deflection control and structural integrity of the elongated shaft or neck of a stringed musical instrument.

It is another object of this invention to provide a device which is substantially rigid and yet adjustable to affect deflection control at predetermined locations along the neck of a stringed musical instrument.

It is still another object of this invention to provide a device that imparts substantially only the desired bending forces to the instrument neck, without subjecting the neck to additional and undesired forces.

It is yet another object of this invention to provide a device which is easily and quickly adjusted to correct undesirable deflections in the neck.

It is a further object of this invention to provide a device which may be utilized to enhance the structural stiffness of the neck in which it is carried.

Yet another object of the invention is to provide an easily removable and replaceable device for affecting deflection control and structural integrity of an elongated neck.

It is an additional object of this invention to provide a device which can correct longitudinal and/or lateral neck deflections which occur along or simultaneously along the neck.

SUMMARY OF THE INVENTION

These objects are achieved by a device according to the invention which includes a sleeve adapted to extend along the elongated shaft or neck of a stringed musical instrument. At least one core element is accommodated within the sleeve and is of a predetermined size and length. Adjustably secured to as least one end of the sleeve is a control element, which is adapted to cooperatively engage with the core element in the sleeve to affect predetermined and controlled deflection of the sleeve. The controlled deflection of the sleeve is imparted directly to the neck or shaft in which the sleeve is accommodated.

In one illustrative embodiment a substantially rigid elongated sleeve is positioned in a similarly dimensioned slot extending substantially longitudinally and centrally of the neck of a stringed musical instrument. The sleeve is provided with adjustable and complemental pistons at opposite ends thereof, capable of limited movement longitudinally of the sleeve. Within the sleeve and between the pistons which are adjustable secured thereto, are a plurality of core elements upon which the pistons may bear. The position and length of the core elements, and the cooperating engagement of the core elements with the pistons will affect predetermined deflection control of the sleeve in which the core elements are accommodated.

Other objects, advantages and features of the invention will become apparent upon reading the following detailed description and appended claims, and upon reference to the accompanying drawing.

BRIEF DESCRIPTION OF THE DRAWINGS

For a complete understanding of this invention, reference should now be made to the embodiment illustrated in greater detail in the accompanying drawings and described below by way of an example of the invention.

IN THE DRAWINGS:

FIG. 1 is a fragmentary perspective view, partially cut away, of a stringed musical instrument showing the preferred embodiment of the device employing principles of this invention, in position within the shaft or neck of the stringed musical instrument.

FIG. 2 is an enlarged fragmentary perspective view of one end portion of the sleeve disposed within the musical instrument neck shown in FIG. 1.

FIG. 3 is an enlarged perspective view of the device of FIG. 1 showing the component parts in exploded relation.

FIG. 4 is an enlarged logitudinal sectional view of the device of FIG. 3 with the components parts thereof shown in one position of adjustment.

FIG. 5 is an enlarged longitudinal sectional view, similar to FIG. 4, but showing the device, and the component parts thereof, in a second position of adjustment.

FIG. 6 is an enlarged longitudinal sectional view, similar to FIG. 4, but illustrating the device and modified component parts thereof in a third position of adjustment.

FIG. 7 is an enlarged longitudinal sectional view, similar to FIG. 4, illustrating the device in a fourth position of adjustment.

FIG. 8 is an enlarged longitudinal sectional view, similar to FIG. 4, illustrating the device in a fifth position of adjustment.

FIG. 9 is an enlarged cross-sectional view of the device of FIG. 4, taken along the line 9—9 thereof.

FIG. 10 is an enlarged cross-sectional view, similar to FIG. 9, and illustrating an alternative configuration for the preferred embodiment of the device.

While the invention will be described in connection with a preferred embodiment, it will be understood that the description is not intended to limit the invention to that particular embodiment. On the contrary, it is the intent to cover all alternatives, modifications and equivalents as may be included with the spirit and scope of the invention as defined by the appended claims.

DESCRIPTION OF THE PREFERRED EMBODIMENT

Turning now to the drawings and principally to FIG. 1, the preferred embodiment of a neck adjusting device 10 according to the invention is shown in position within the elongated shaft or neck 12 of a conventional stringed musical instrument 14, such as an electric guitar.

The neck 12 is typically formed from a single piece of hardwood 16 or other solid material, and is of greater cross-dimensional thickness 18 where it joins with the body 20 or sound box, and tapers toward the headpiece 22. The hardwood piece 16 is overlaid by a fingerboard 24 (FIG. 2). The fingerboard 24 is usually a strip of stiff material, such as rosewood or ebony, of near uniform thickness, being substantially co-extensive with the hardwood 16 thereunder. In the case of a guitar or other fretted stringed instruments, a plurality of ribs or frets 26 are secured in elevated relation to the fingerboard 24 running in substantially perpendicular relation to the elongated dimension D of the fingerboard 24. The frets 26 are secured in a predetermined spaced relation along the neck 12 to achieve predetermined musical pitches when the strings 28 of the instrument are depressed by finger or other pressure into contact with a predetermined fret, and the strings 28 are struck, plucked, bowed or otherwise vibrated.

The strings 28 are secured at one end (not shown) to the sound box 20 and at the other end to string posts 30 which are adjustably secured in and extend through the headpiece 22. The strings extend through a slotted nut 32 mounted at the juncture of the fingerboard 24 and the headpiece 22. The nut 32 assures proper separation between adjacent strings 28, and supports the strings 28 a predetermined distance over the fingerboard 24 and the raised frets 26. Proper string tension is achieved by rotation of the string posts 30, which wrap the excess string round the post 30.

Because the string tension may be substantial, and due to the extensive length and narrow cross-sectional thickness of the neck 12, it is often necessary to structurally support or grid the neck 12 to prevent unwanted deflection thereof which would result in a loss of playability. Such stiffening is accomplished by the incorporation or placement of a metal sleeve or tube 34 within the neck 12, under the fingerboard 24.

As shown in the preferred embodiment of this invention, the device 10 includes a substantially square and elongated steel tube 34 (FIG. 3), which is adapted for placement within a slot 36 cut into the neck 12 and extending its full length. The slot 36 and the tube 34 are of substantially the same dimensions to assure a close fit of the tube 34 within the instrument's neck 12.

It is envisioned that the tube 34 is of substantially the same length as the neck 12, and that the tube 34 will be substantially hidden by the placement of the fingerboard 24 over the hardwood 16 or other material. The tube 34 may be substantially shorter or longer than the neck 12, without substantially detracting from the invention. Similarly, the slot 36 may act as and replace the tube 34, although the neck 12 would thereby be subjected to additional and undesirable forces.

It is desirable, in most instances, to have an end of the tube 34 (FIG. 2) extend into the headpiece 22. This is because the junction 40 between the neck 12 and the headpiece 22 is particularly structurally weak due to the relatively thin and flat cross-section of the headpiece 22. The junction 40 is further weakened by the existence of the slot 36 or other similar opening which is frequently cut into the headpiece 22 to expose one end of the neck adjusting device 10. This slot has been necessary in the past to allow for adjustment of prior art adjusting devices. However, such prior art devices have not, at the same time, acted to substantially reinforce the junction 40.

According to this invention, the tube end 38 extends into the headpiece 22, but may be bevelled or contoured to remain substantially flush with the upper surface 42 of the headpiece 22, when the tube 34 is positioned within the neck slot 36. In this way, the junction 40 between the neck 12 and the headpiece 22 is strengthened, while access to the device 10 for the purpose of adjustment is unabstructed, as hereinafter described. Although the device is effective without gluing or otherwise securing the tube 34 within the slot 36, additional strength will be added to the junction 40 by gluing the tube 34 at that location. The exposed tube end 38 may be hidden, for aesthetic purposes, by the placement of a head plate 44 thereover.

The tube 34 defines a substantially square inner passage 46 (FIGS. 9, 10) extending the length thereof. The end portions 38, 48 of the tube 34 have been tapped 50 to accept a threaded piston or plug 52, 54 or the like therein. The tube 34 may be tapped along its entire length, if so desired, thus allowing full length longitudinal motion of the pistons 52, 54 and/or allowing the use of a plurality of said pistons.

Each piston 52, 54 includes an indented slot 56 on one end thereof, which is adapted to accept the working end 58 (FIGS. 4, 5, 6, 7) of an Allen wrench 60 or similar tool. Rotation of the pistons 52, 54 when engaged with the threads 61 of the tube 34, as accomplished by the rotation of the Allen wrench 60 when inserted into piston slot 56, will cause longtiudinal motion of the piston(s) 52, 54 within the tube 34.

Positioned with the tube passage 46 between the pistons 52, 54 are a plurality of core elements 62 of predetermined thickness and length (i.e., shape). The core elements 62 may be separated from the pistons 52, 54 and from each other by core blocks 64 of substantially the same dimension as the inner passage 46. As described hereinafter, the selection and placement of the core elements 62 within the tube passage 46 is directly related to the deflection characteristics of the device 10.

The core elements 62 are generally, in thickness T (FIG. 9), ½ the dimension A of the inner passage 46 (see FIGS. 9, 10). The length L of the core pieces 62 between core blocks 64 will vary, depending on the deflection characteristics to be achieved. If any bending is desired between two core blocks 64, however, the length L of one core piece **62*a* (FIG. 9, 10) will be longer than the combined or single length M of adjacent core piece or pieces 62*b***.

It should also be clear that the desired deflection characteristics are achieved by a single, irregularly-shaped core element of a thickness approaching dimension A and having a lengthwise dimension L along at least one part of the core element—as is achieved by permanently joining and securing facing core pieces **62*a*, 62*b* into a single core element. The core pieces 62*a*, 62*b* and core blocks 64** are each constructed from solid machined steel, or other material capable of maintaining its original shape when subjected to compressive forces.

Vibration of the core pieces **62*a*, 62*b* and core blocks 64 within tube 34 may be eliminated by restricting the motion of the core pieces 62*b*** with grease or other matter.

Between the core blocks 64 at each end of the tube 34, and the pistons 52, 54 are ball bearings 66 which minimize the resistance to rotation of the pistons 52, 54 when in an engaging relation with the bearings 66, core blocks 64 and core pieces 62, respectively. In addition, bearings 66 alleviate torque forces which might otherwise result if the pistons 52, 54 were rotated against the core blocks 64 or core pieces **62*a*, 62*b***.

In operation, the neck adjusting device 10 is positioned within the slot 36 cut into the neck 12 of a guitar 14 or other musical instrument. If large deviations or distortions 12 can be expected, the tube 34 of the device 10 should be secured along its full length with an epoxy glue or the like, to the hardwood portion 16 of the neck 12 defining the slot 36. In this secured relation, the action of the tube 34 will be more completely and accurately transferred to the surrounding hardwood 16 of the neck 12.

If, however, only small distortions of the neck 12 can be anticipated, it is not necessary to secure the device to the neck 12, since the device does not depend upon the neck 12 to affect deflection of the sleeve 34—i.e. the device is self-contained.

The slot 36 need only be a simple, square, straight dado cut in appearance, which thus presents a simple manufacturing task.

Prior to the placement of the tube 34 into the neck slot 36, it may be desirable to rotate the piston 54 into position within the threaded end 48 of the tube 34, because the end 48 of the tube 34 will usually be less accessable than the opposite end 38 of the tube 34.

It will be understood, of course, that one of the ends 38, 48 of the tube passage 46 may be otherwise blocked or permanently closed without detracting from the scope of this invention.

Once secured or positioned within the neck slot 36, the fingerboard 24 is secured to the hardwood 16, over the tube 34, leaving only the end portions 38, 48 exposed at the heatpiece 22 and at the opposite end of the slot 36 respectively. It should be noted, however, that because it is not necessary to fixedly secure the tube 34 within the neck 12, and because the slot 36 is not contoured or sloped, the tube 34 may be inserted and/or removed from the slot 36 after the fingerboard 24 is in place. With the fingerboard 24 in place over the hardwood 16, however, the tube 34 will be snuggly retained within the neck 12.

When a determination is made that warpage or other distortion of the neck 12 has occurred, as by deterioration of playability or other observed characteristics, the core pieces 62 and core blocks 64 may be arranged and loaded into the passage 46 at the end 38 of the tube 34, with the piston 52 moved into engaging relation with the ball bearing 66, the core block 64 and the core pieces 62, respectively, to counteract the detremental neck deflections.

For example, if it has been determined that the neck 12 has warped (i.e. that the headpiece 22 has moved vertically upwardly, viewing the instrument as shown in FIG. 1), a counteracting, generally downward force must be imparted to the neck 12. As shown in FIG. 4, this counteracting downward force is accomplished by arranging the core pieces or elements such that the longer core pieces **62*a* overly, as in FIG. 4, the shorter core pieces 62*b*. It should be recalled that the combined length M (FIG. 3) of core pieces 62*b* is shorter than the length L of the longer core piece or pieces 62*a***.

When compressive force F (FIG. 4) is exerted against the core blocks 64 on opposite ends 38, 48 of the passage 46 by the longitudinal movement of piston 52 and bearing 66, the force F will be exerted on the longer core pieces **62*a* along the upper ½ of the tube passage 46. Correspondingly, a resultant tension force G (FIG. 4) will be imparted substantially along the upper ½ 70 (FIG. 9) of the tube 34. Simultaneously, the lower portion 72 of the tube 34 will be subject to a lesser tension force. As a result, because the core pieces 62*b* are of shorter length M (FIG. 3) than the core pieces 62*a*, and are not abutting, the tube 34** will be deflected downwardly.

The amount of permissable deflection will depend, to a point, upon the differential in length between the longer and shorter core pieces **62*a* and 62*b*, respectively, the arrangement of said core pieces, the characteristics of the material of the tube 34, and the tension imparted to the device 10 by the pistons 52, 54. The number and lengths of the core pieces 62*a*, 62*b* will determine the smooth and/or localized deflection of the tube 34**.

Although some minimal stretching of the tube 34 may occur, the stretching will generally have a negligable effect on the structural integrity of the neck. No such stretching, of course, will be imparted to the neck if the device 10 is carried within, but not secured to the slot 36.

FIGS. 5, 7 and 8 illustrate additional bending characteristics and directional deflections that can be achieved by arranging the core pieces 62 and core blocks 64 according to the above teachings.

FIG. 6 illustrates the use of the device 10 as a girding structure imparting additional stiffness to the neck 12 by imparting additional stiffness to the tube 34. A single core piece 80 may be utilized since no bending of the device 10 (FIG. 6) is desired. Such stiffening will also correct minor deflections in the neck 12.

If a plurality of core pieces 62 are used to simulate the solid core piece 80 (FIG. 6), it will be understood that the combined lengths of the upper and lower sets of core pieces 62*a*, 62*b* must be substantially equal. When the solid core piece 80 is replaced by a plurality of core pieces 62*a*, 62*b*, the individual upper and lower core pieces 62*a*, 62*b* should be overlapped so as to avoid a co-terminal endwise alignment of individual upper and lower core pieces 62*a*, 62*b*. If such a co-terminal endwise alignment is achieved, undesired deflection of the device 10 may occur at the point of co-terminal alignment between core pieces.

It should be obvious from the above discussion that an elongated core piece 80 or pieces 62 may be employed in conjunction with shorter and/or various length core pieces 62*a*, 62*b* to achieve desired localized deflection as in FIG. 8.

While the core pieces 62 in FIGS. 3, 4, 5, 7, 8 have been overlaid as shown in FIG. 9, with resulting deflection in the vertical, up-down, direction, it whould be noted that deflection in the horizontal direction can likewise be achieved by positioning the core pieces 62*a*, 62*b* in a side-by-side relation as shown in FIG. 10. Deflection control in other planes can be achieved by using 3 or more core pieces 62 to occupy the cross-sectional opening 46 in the tube, by installing the tube 34 on a different axis in the neck 12, and/or by employing a different cross-sectional shape of the tube 34.

Finally, depending on the selection of materials for, and the location and amount of tension exerted on the tube 34, an inelastic deflection thereof may be accomplished. If a desired inelastic deflection of the tube 34 is achieved, the core blocks 64, core pieces 62, ball bearings 66 and pistions 52, 54 can be removed from the tube 34, to decrease the weight of the neck 12.

Thus, a device is provided that is self-contained, replaceable, and capable of correcting and/or re-correcting an infinite number of improper neck deflections. While a particular embodiment of the invention has been shown, it will be understood, of course, that the invention is not limited thereto since modifications may be made and other embodiments of the principles of this invention will occur to those skilled in the art to which the invention pertains, upon consideration of the foregoing teachings.

It is, therefore, contemplated by the appended claims to cover any such modifications and other embodiments as incorporate those features which constitute the essential features of this invention, within the true spirit and scope of the following claims.

We claim:

1. A device for affecting deflection control of an elongated musical instrument member, comprising a sleeve adapted to extend along and be carried by the elongated member, sleeve deflection means of predetermined shaped, and selectively and removably positioned within said sleeve, and adjustable control means mounted on said sleeve and selectively coacting with said sleeve deflection means to affect controlled directional and locational deflection of said sleeve and the elongated member carrying said sleeve.

2. The device of claim 1, wherein said sleeve deflection means includes a plurality of core elements of predetermined lengths.

3. A device for affecting deflection control of an elongated musical instrument member, comprising a sleeve adapted to extend along and be carried by the elongated member, sleeve deflection means including a plurality of core elements of predetermined lengths wherein a set of said core elements is disposed within said sleeve and includes first and secnd core elements of differential lengths disposed in face-to-face relation, and adjustable control means mounted on said sleeve and selectively coacting with said sleeve deflection means to affect controlled deflection of said sleeve and the elongated member carrying said sleeve.

4. The device of claim 3, wherein said control means selectively engages the longer of said first and second core elements to affect controlled and predetermined deflection of said sleeve.

5. The device of claim 4, wherein a plurality of said core element sets are disposed within said sleeve in end-wise relation, said adjacent core element sets separated by a core block piece disposed therebetween.

6. The device of claim 5, wherein the longer core elements of said core element sets are disposed within said sleeve in substantially longitudinal alignment, affecting predictable single directional deflection of said sleeve.

7. The device of claim 5, wherein a predetermined number of said longer core elements of said core element sets are disposed within said sleeve in substantially non-aligned relation, affecting predictable multi-directional deflection of said sleeve.

8. The device of claim 3, wherein said first and second core elements of said core element set are disposed in overlying relation.

9. The device of claim 3, wherein said first and second core elements of said core element set are disposed in side-by-side relation.

10. A device for affecting deflection control of an elongated musical instrument member, comprising a sleeve adapted to extend along and be carried by the elongated member, a pluralty of core elements removably disposed within said sleeve and arranged in sets of differential length first and second core elements disposed in face to face relation, said core element sets disposed in longitudinal end-wise relation, core block means disposed within said sleeve and between adjacent sets of said core elements, and adjustable control means mounted on said sleeve and selectively coacting with said core elements in said core element sets to affect controlled and predictable directional deflection of said sleeve and the elongated member carrying said sleeve.

11. The device of claim 10, wherein said sleeve is a substantially rigid open-ended tube, said tube including a threaded portion therealong.

12. The device of claim 11, wherein said adjustable control means includes a threaded piston disposed within and adjustably mounted to said tube along the threaded portion thereof.

13. The device of claim 12, wherein said piston adjustably coacts with the longer core element of said core element sets to affect controlled directional deflection of said tube.

14. The device of claim 13, wherein a threaded piston is adjustably mounted in said tube toward each opposite end of said tube.

15. The device of claim 14, wherein said pistons engage core block means disposed within said tube between said pistons and a set of said core elements.

16. The device of claim 15, wherein a bearing means is provided between said core block means and said threaded pistons.

* * * * *